US005718085A

United States Patent [19]

Plum

[11] Patent Number: 5,718,085

[45] Date of Patent: Feb. 17, 1998

[54] GUTTERS

[76] Inventor: Horst Peter Plum, 47 Viben Avenue, Brackenfell 7560, South Africa

[21] Appl. No.: 602,504

[22] Filed: Feb. 20, 1996

[30] Foreign Application Priority Data

Feb. 28, 1995 [ZA] South Africa ..... 95/1631

[51] Int. Cl.[6] ..... E04D 13/00

[52] U.S. Cl. ..... 52/11; 248/48.1

[58] Field of Search ..... 52/11, 12, 13, 52/14, 15; 248/48.1, 48.2

[56] References Cited

U.S. PATENT DOCUMENTS 2,843,063 7/1958 Thomson ..... 248/98.1 X 4,455,791 6/1984 Elko et al. ..... 52/12

5,537,785 7/1996 Zaccagni ..... 52/11

*Primary Examiner*—Creighton Smith

*Attorney, Agent, or Firm*—Workman, Nydegger & Seeley

[57] ABSTRACT

According to the invention, a gutter for collecting and conveying water from a roof of a building includes an elongated channel having a rear wall for abutment against a fascia or other building member; a front wall spaced away from the rear wall land having an upper edge; a floor joining the rear wall and the front wall; and a coupling formation at the upper edge of the front wall for engagement with a bracket having an associated engagement formation, the bracket being attachable to a support structure, such as a rafter.

8 Claims, 3 Drawing Sheets

GUTTERS

FIELD OF INVENTION

The present invention relates to gutters.

More particularly, the invention relates to gutters for collecting and conveying water from roofs of buildings.

BACKGROUND TO INVENTION

Various types of such gutters are known. These conventional gutters often are not only unattractive but it is time consuming to mount such gutters against a fascia of a building or to remove the gutters for repair or replacement purposes.

It is an object of the invention to suggest a simplified type of gutter which is relatively easy to mount or to remove.

SUMMARY OF INVENTION

According to the invention, a gutter for collecting and conveying water from a roof of a building includes an elongated channel having a rear wall for abutment against a fascia or other building member; a front wall spaced away from the rear wall and having an upper edge; a floor joining the rear wall and the front wall; and a coupling formation at the upper edge of the front wall for engagement with a bracket having an associated engagement formation, the bracket being attachable to a support structure, such as a rafter.

The floor and the rear wall may define an angle of substantially 90° between them.

The front wall may be inclined relative to the floor.

The front wall may be provided in angled steps progressively distanced further away from the rear wall.

The coupling formation may be in the form of a hook defining an acute angle of between 10° to 50° between its legs.

The gutter may include at least one discharge hole in the floor at which a downpipe is attachable.

The front wall may have at least one overflow hole at which a spout is provided.

The gutter may be made of sheet metal.

Also according to the invention, a gutter arrangement includes (a) an elongated channel having a rear wall for abutment against a fascia or other building member, a front wall spaced away from the rear wall and having an upper edge, a floor joining the rear wall and the front wall, and a coupling formation at the upper edge of the front wall; and (b) a number of spaced apart brackets, each having an associated engagement formation engaging with the coupling formation of the front wall, each bracket being attachable to a support structure such as a rafter.

Each bracket may include a first part having the engagement formation at one end, an attachment section for attachment to a support structure, and a second part joined to the first part and including a rear section abutting against the rear wall of the gutter on its inside, a front section abutting against the front wall of the gutter on its inside, and a joining section joining the front section and the rear section.

BRIEF DESCRIPTION OF DRAWINGS

The invention will now be described by way of example with reference to the accompanying schematic drawings.

In the drawings there is shown in.

DETAILED DESCRIPTION OF DRAWINGS

Figure 1:
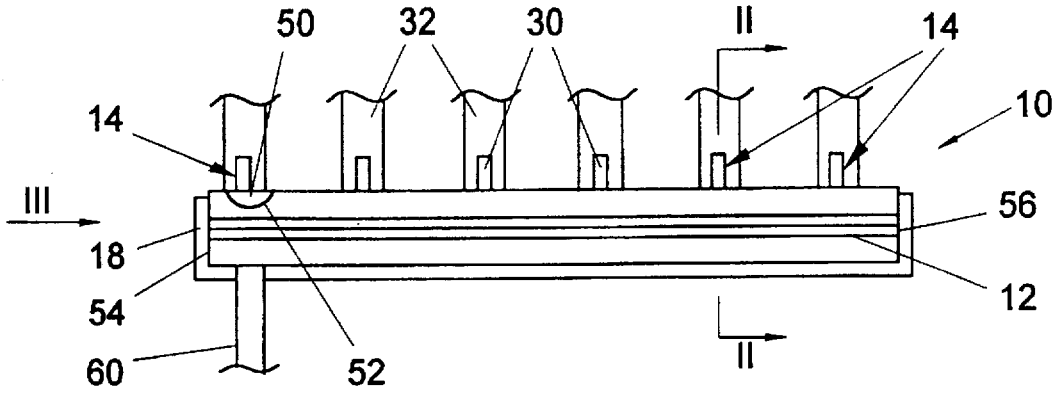
FIG. 1 a front view of a gutter arrangement in accordance with the invention.

Referring to FIG. 1, the gutter arrangement, generally indicated by reference numeral 10, includes an elongated channel shaped gutter 12 and a number of spaced apart support brackets 14.

Figure 2:
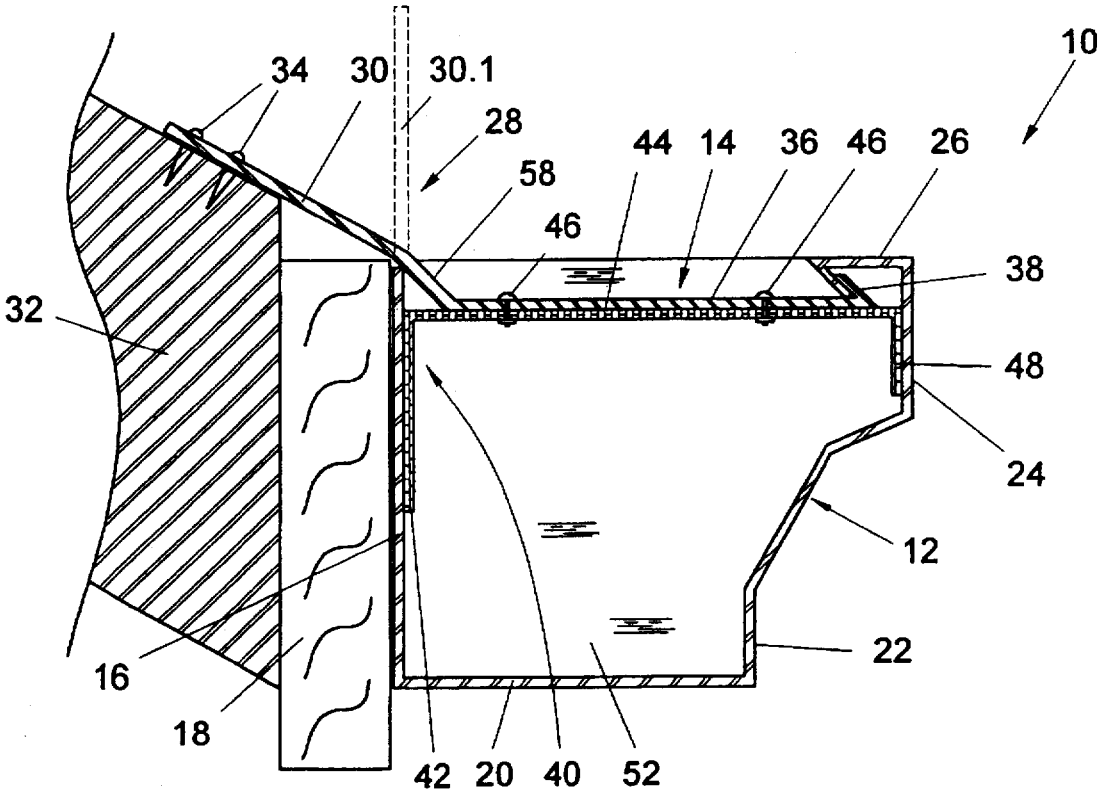
FIG. 2 a sectional side view of the gutter arrangement seen along arrows II—II in FIG. 1 but on an enlarged scale.
Figure 3:
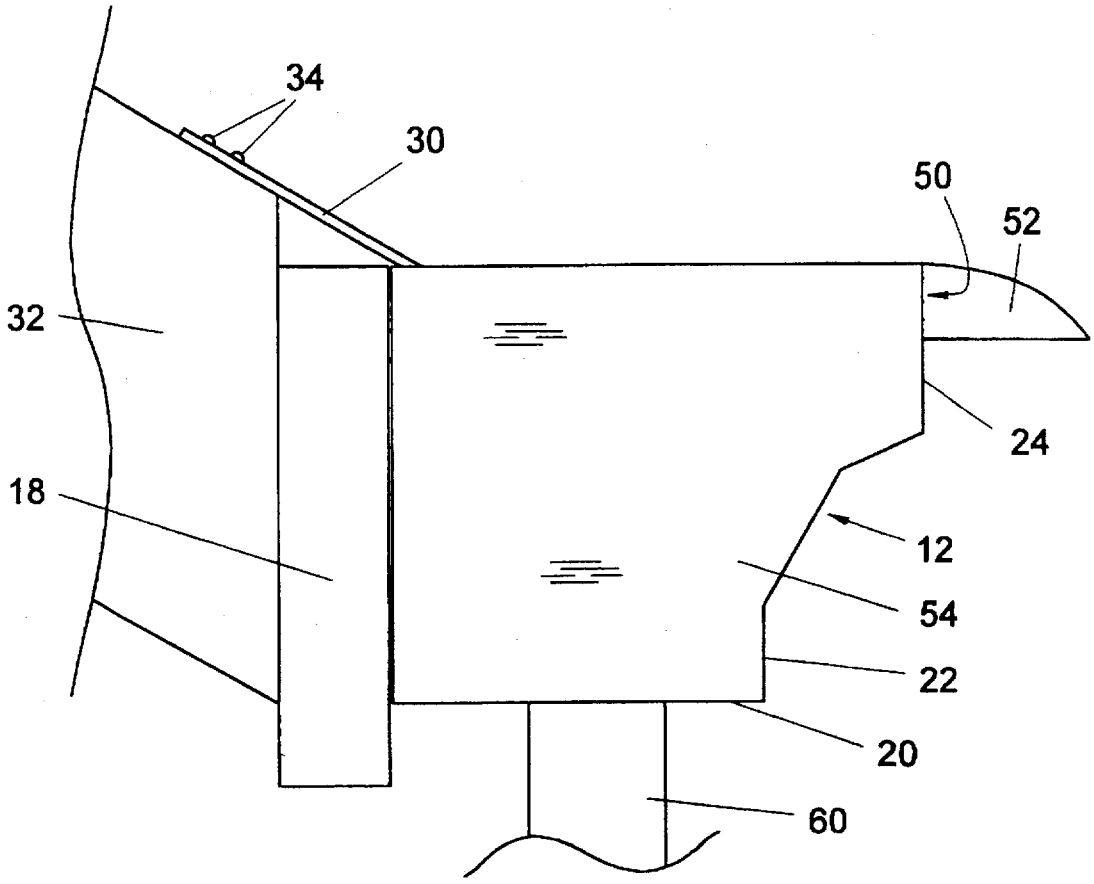
FIG. 3 a side view of the gutter arrangement as seen along arrow III in FIG. 1 but on an enlarged scale.

As is shown in detail in FIGS. 2 and 3, the gutter 12 is constituted by a rear wall 16, which can abut against a fascia 18 or other support structure, a floor 20 extending at right angles from the rear wall 16, a front wall 22 which extends away in angular stepped sections upwardly from the floor 20 and at its upper part 24 is provided with a coupling hook 26.

Each bracket 14, which is made of a strip of metal, includes a first or upper connecting part 28 having a rear leg 30 for attachment to a rafter 32 or other support structure, e.g. by way of nails 34, a horizontal leg 36 and a hook 38 for engagement with the coupling hook 26.

The bracket 14 further includes a second or lower part 40 having a rear leg 42 abutting against the inner face of the rear wall 16 on its inner side, a horizontal leg 44 connected to the leg 36 by means of bolt and nuts or rivets 46 and a front leg 48 abutting against the inner face of the upper part 24 of the front wall 22.

In use a number of spaced apart brackets 14 are fitted to the gutter 12 as shown in FIG. 1 and then the gutter arrangement 10 is fitted to rafters 32 by placing the rear wall 16 against the fascia 18 and by attaching the leg 30 of each bracket 14 to its rafter 32 by way of nails 34.

In practice when the gutter arrangement 10 is positioned, the leg 30 will stand upright as indicated in dotted lines by reference numeral 30.1 in FIG. 1 and for attachment will be bent over into the required inclined position as shown in FIGS. 2 and 3, obviously depending on the particular location of the rafter 32 or other support structure.

It must be noted that the position of the rafter 32 in FIGS. 2 and 3 merely shows one position. The rafter 32 may be located higher or lower relative to the fascia 18.

A hole 50 is provided in the upper part 24 of the front wall 22 where a spout 52 is fitted. Such a spout conveniently is provided opposite each and every outlet from the gutter 12 leading into a downpipe.

The gutter 12 is provided in convenient lengths and the ends are closed off by means of end walls 54, 56.

The gutter arrangement 10 is made of suitable sheet metal.

The bent rear cprner 58 of the connecting part 28 prevents the gutter 12 from moving up behind the bracket 14 or to twist out of shape.

Figure 4:
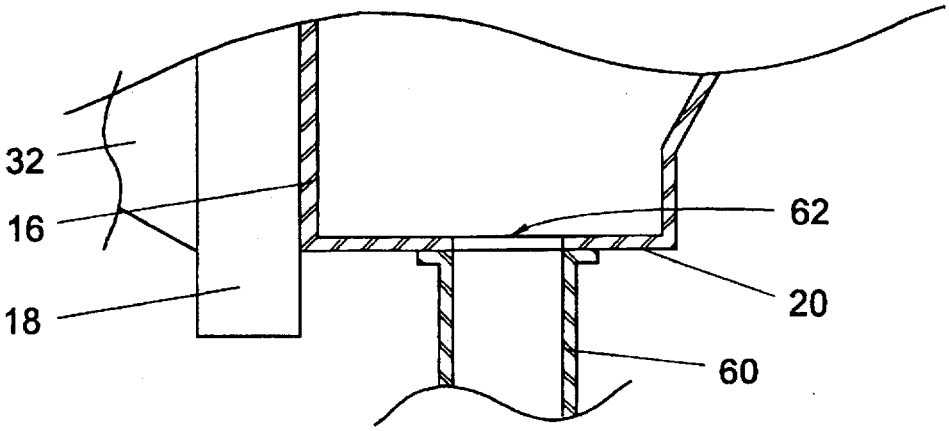
FIG. 4 a sectional side view through a downpipe when fitted to a gutter as illustrated in FIG. 2.

Referring to FIG. 4, a downpipe 60 is shown to be fitted in a hole 62 provided in the floor 20 of the gutter 22. The downpipe 60 may be riveted to the floor 20, e.g. by having a collar 63 as shown.

Figure 5:
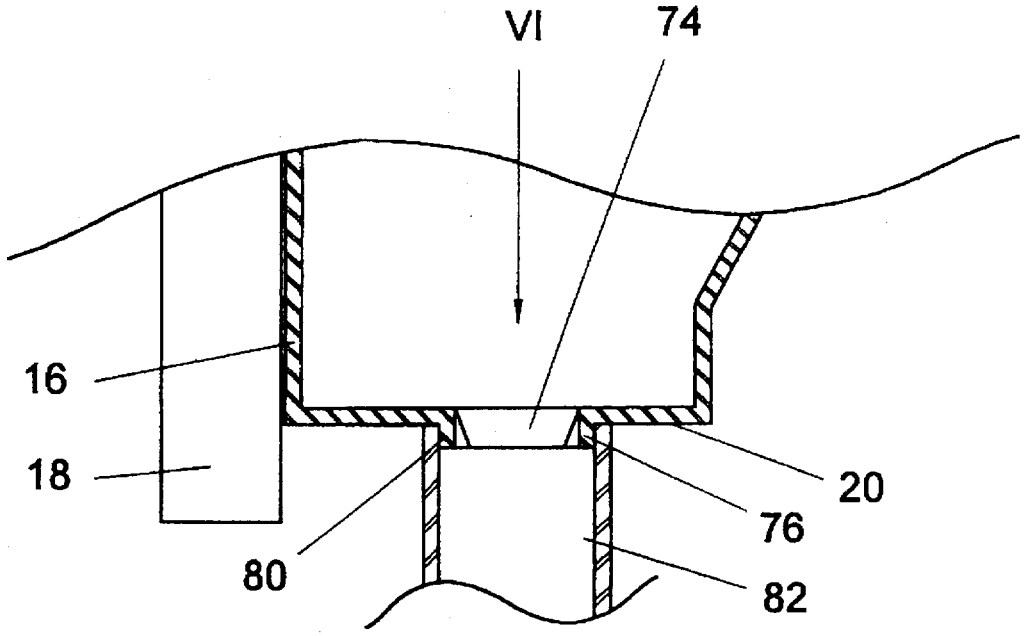
FIG. 5 a view corresponding to FIG. 4 but showing another embodiment for fitting a downpipe.
Figure 6:
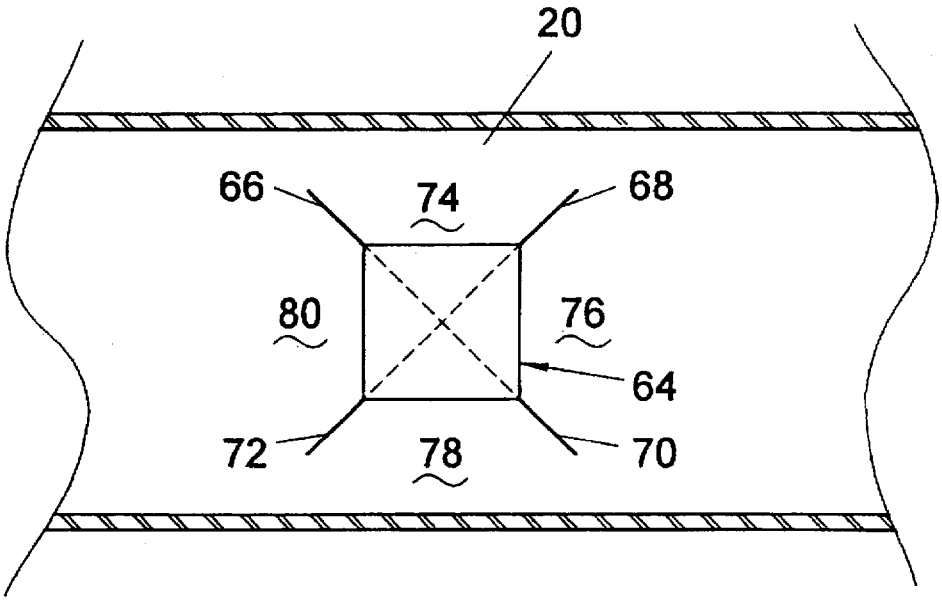
FIG. 6 a plan view seen along arrow VI in FIG. 5 to indicate the formation of a hole for the downpipe.

An alternative arrangement for fitting a downpipe is shown in FIGS. 5 and 6. Here a collar is created by cutting out a rectangular hole 64 in the gutter floor 20 as shown in FIG. 6 and further providing opposite cuts 66, 68, 70, 72. Thereafter the parts 74, 76, 78, 80, defined between these cuts, are bent downwardly to form a collar. The downpipe 84 is fitted into the collar and is riveted to the bent down parts 74, 76, 78, 80.

The suspension of the gutter 12 by way of the brackets 14 allows the gutter 12 to move horizontally, e.g. as a result of thermal movement.

Furthermore, the brackets 14 allow the gutter 12 to be removed easily for repair or replacement by simply dislocating the brackets 14 from the gutter 12, i.e. by unclipping the hooks 34 from the hooks 26.

I claim:

1. A gutter arrangement for collecting and conveying water from a roof of a building which includes:

a gutter comprising:

(a) an elongated channel having a rear wall for abutment against a fascia; a front wall spaced away from the rear wall and having an upper edge having a coupling formation, a floor joining the rear wall and the front wall; and gutter attachment means comprising:

(b) a number of spaced apart brackets for suspending said gutter from a building such that said gutter is movable horizontally, each said bracket having an engagement formation at one end engaging with the coupling formation at the upper edge of the front wall and having an attachment end at the other end for attaching the bracket to a support structure, each bracket including a first part having the engagement formation at one end, an attachment section for attachment to a support structure, and a second part joined to the first part and including a rear section abutting against the rear wall of the cutter on its inside, a front section abusing against the front wall of the gutter on its inside, and a joining section joining the front section and the rear section.

2. A gutter as claimed in claim 1, in which the floor and the rear wall define an angle of substantially 90° between them.

3. A gutter as claimed in claim 1, in which the front wall is inclined relative to the floor.

4. A gutter as claimed in claim 3, in which the front wall is provided in angled steps progressively distanced further away from the rear wall.

5. A gutter as claimed in claim 1, in which the coupling formation is in the form of a hook defining an acute angle of between 10° to 50° between its legs.

6. A gutter as claimed in claim 1, which includes at least one discharge hole in the floor at which a downpipe is attachable.

7. A gutter as claimed in claim 1, in which the front wall has at least one overflow hole at which a spout is provided.

8. A gutter as claimed in claim 1, which is made of sheet metal.

* * * * *

UNITED STATES PATENT AND TRADEMARK OFFICE

CERTIFICATE OF CORRECTION

PATENT NO. : 5,718,085

DATED : Feb. 17, 1998

INVENTOR(S) : Horst Peter Plum

It is certified that error appears in the above-identified patent and that said Letters Patent is hereby corrected as shown below:

Col. 2, line 46, after "FIG." change "1" to --2--

Col. 2, line 61, after "rear" change "cprner" to --corner--

Col. 3, line6 , after "downpipe" change "84" to --82--

Col. 3, line 15, after "hooks" change "34" to --38--

Col. 4, line 7, after "the" change "cutter" to --gutter--

Col. 4, line 8, after "section" change "abusing" to --abutting--

Signed and Sealed this

Eighth Day of June, 1999

*Attest:*

Q. TODD DICKINSON

*Attesting Officer*

*Acting Commissioner of Patents and Trademarks*